US007491113B2

(12) United States Patent
Bowler

(10) Patent No.: US 7,491,113 B2
(45) Date of Patent: Feb. 17, 2009

(54) POST-SURGICAL COMFORT BRASSIERE AND METHOD OF MAKING

(75) Inventor: Dorothy Vivian Bowler, Camano Island, WA (US)

(73) Assignee: Gentle Bra, LLC, Camano Island, WA (US)

( * ) Notice: Subject to any disclaimer, the term of this patent is extended or adjusted under 35 U.S.C. 154(b) by 400 days.

(21) Appl. No.: 11/226,159

(22) Filed: Sep. 14, 2005

(65) Prior Publication Data

US 2006/0057937 A1 Mar. 16, 2006

Related U.S. Application Data

(60) Provisional application No. 60/610,454, filed on Sep. 16, 2004.

(51) Int. Cl.
*A41C 3/00* (2006.01)
*A11C 3/00* (2006.01)

(52) U.S. Cl. ..... 450/60; 450/61; 450/65

(58) Field of Classification Search ..... 450/1, 450/59, 60, 61, 65–67, 70, 74–76, 92, 93; 66/171, 172 R, 169 R, 172 E; 2/73, 105, 2/106, 113, 115

See application file for complete search history.

(56) References Cited

U.S. PATENT DOCUMENTS

| | | | | | |
|---|---|---|---|---|---|
| 2,644,162 | A | * | 7/1953 | Schaumer | 450/66 |
| 2,651,040 | A | * | 9/1953 | Block | 450/30 |
| 3,056,411 | A | * | 10/1962 | Child | 450/65 |
| 3,430,632 | A | * | 3/1969 | James et al. | 450/1 |
| 4,174,717 | A | * | 11/1979 | Schreiber et al. | 450/70 |
| 4,531,525 | A | * | 7/1985 | Richards | 450/65 |
| 4,909,771 | A | * | 3/1990 | Bergman | 450/3 |
| 5,479,791 | A | * | 1/1996 | Osborne | 66/171 |
| 5,553,468 | A | * | 9/1996 | Osborne | 66/171 |
| 5,944,579 | A | * | 8/1999 | Fleischman | 450/69 |

OTHER PUBLICATIONS comfortbra.com homepage, retrieved Jan. 30, 2006 from www.comfortbra.com, pp. 1-3.

* cited by examiner

*Primary Examiner*—Gloria Hale
(74) *Attorney, Agent, or Firm*—Seed IP Law Group PLLC

(57) ABSTRACT

A garment and a method of constructing a garment for supporting at least one breast that includes a common hammock for the breasts formed by a pair of front panels. Example embodiments provide a comfort brassiere, which can be worn at all times, including after surgery.

7 Claims, 10 Drawing Sheets

POST-SURGICAL COMFORT BRASSIERE AND METHOD OF MAKING

CROSS-REFERENCE TO RELATED APPLICATION

This application claims the benefit under 35 U.S.C. § 119 (e) of U.S. Provisional Patent Application No. 60/610,454 filed Sep. 16, 2004, where this provisional application is incorporated herein by reference in its entirety.

BACKGROUND OF THE INVENTION

1. Field of the Invention

The present invention pertains to a garment for supporting the human breast and, more particularly, to a post-surgical comfort brassiere and method of making.

2. Description of the Related Art

Traditionally, the only acceptable form of undergarment for women was the corset. The corset was extremely painful and uncomfortable and led to the making of the brassiere. The original brassiere was comprised of two scarves and a ribbon. Since the original brassiere, however, many different styles of brassieres have been made. Today's brassieres are generally formed of fabric and include four elements: cups, closures, shoulder areas, and bands.

One drawback of the present brassieres is that the cups rub, compress, and irritate the chest wall tissue. Some cups include seams, under-wires, and side stays incorporated into them that poke, put pressure on and irritate the chest wall, the ribcage, and the underarm areas. Additionally, closures are available, such as zippers, hook and eyes, hook-and-loop fasteners, and elastics of all types, that chafe and rub when they come into contact with the chest wall or the back, resulting in extreme pain following upper torso surgeries, such as, breast, lung, heart, and back surgeries.

Furthermore, the shoulder areas used in the brassieres continuously slide down the shoulders and upper arms of the user, even if the shoulder areas are adjustable. Shoulder areas made of elastic, stretchable material tend to cut and dig into and painfully compress the shoulder area, creating deep grooves. The shoulder areas cause extreme pain following certain types of surgeries, such as, rotary cuff surgeries and surgeries to alleviate bursitis.

In addition, the bands used in the brassieres rub, compress, chafe, and irritate the front rib cage and back of the wearer. The under-band beneath the breasts can cause substantial friction with the human skin that results in excess perspiration. The excess perspiration in combination with the friction can cause rashes and possible infections.

Finally, many brassieres use fabrics that are either one hundred percent synthetic or partially synthetic. Unfortunately, many women are allergic to synthetic materials and break out in painful, itchy rashes. Furthermore, after surgery, some women become more sensitive to synthetic materials. Therefore, brassieres that employ synthetic materials can cause a lot of discomfort.

BRIEF SUMMARY OF THE INVENTION

The disclosed embodiments of the invention are directed to a garment and a method of constructing the garment for supporting at least one breast and a method of constructing such a garment so that it can be used for various purposes, such as a post-surgical brassiere.

In accordance to one embodiment of the invention, a garment is provided that includes a plurality of front panels, each panel having a piece of material configured to be positioned between the breast and the torso to support the breast and to prevent skin-to-skin contact when the garment is worn; and at least one back panel attached to the plurality of front panels.

In accordance with another aspect of the invention, the garment is preferably formed of one-way stretch cotton fabric with the at least one back panel cut along a lengthwise grain of the fabric such that the garment has a vertical stretch to enable the garment to be pulled over the head or stepped into and pulled toward the upper torso.

In accordance with another aspect of the foregoing embodiment, at least one shoulder area is configured to connect a plurality of front panels and the at least one back panel, with the plurality of front panels forming a hammock to hold and lift the breast.

In accordance with another aspect of the present invention, a garment for supporting the human breast is provided that includes a front portion having left and right sides, each of the left and right sides having a hammock formed on an inside surface, the hammock configured to receive the breast with a portion of the hammock positioned between the breast and the torso to prevent skin contact; a rear portion coupled to the front portion to form a body sized and shaped to be received around the human torso; and left and right shoulder areas extending from the front and rear portions.

In accordance with another embodiment of the invention, a method of making a garment to hold at least one breast is provided, the method including providing a plurality of front panels, each panel having a piece of material configured to be positioned between the breast and the torso to prevent skin-to-skin contact when the garment is worm; providing at least one back panel attached to the plurality of front panels; and providing at least one shoulder area.

In accordance with another aspect of the foregoing embodiment, the front panels, and preferably the entire garment, is formed of one-way stretch cotton fabric. Ideally, the at least one back panel is cut along a lengthwise grain of a section of the fabric and the plurality of front panels are cut along a bias-grain of a section of fabric.

In accordance with another aspect of the foregoing embodiment, the at least one back panel is integrally formed with the plurality of front panels. Where stitching is used, stitching styles can include a serger stitch and an elastic stitch.

In accordance with another embodiment of the invention, a device for supporting at least one breast is provided, the device including at least one panel having a section of fabric without metal supports positioned between the breast and the torso, the section of fabric holding and lifting the breast to prevent skin-to-skin contact between the breast and a user's torso when the garment is worn.

In accordance with yet a further embodiment of the invention, the hammock design of the present invention is configured to automatically conform to the changing size and shape of the breast moment by moment throughout the day and night during and following the healing process.

As will be readily appreciated from the foregoing, the present invention provides a brassiere without cups that comfortably cradles each breast as it finds its own level in as much as every breast has its own configuration and size. The particular material used enables the brassiere to be stretched, thus allowing users to step into the brassiere easily and comfortably or to be put on over the head without raising an arm high, which is prohibited after breast, lymph-node, and shoulder surgery.

The disclosed embodiments of the present invention also provide a brassiere whose shoulder area is not segmented, does not need adjusting, will not slip down, will not put pressure on the shoulder nerves or muscles, and is comfortably wide. In addition, the brassiere eliminates an underband beneath the breasts while separating the breasts from the skin of the torso and the ribcage. Comfortable cotton fabric provides a soothing feeling and mitigates irritation while protecting tender tissues and medications.

In addition, the present invention provides a brassiere that can be custom sized and comfortable for any size of ribcage and breast size. Ideally, the brassiere is machine washable and dryable, is reasonably priced, and is formed of material that breaths to reduce pain and is lightweight to reduce the costs of shipping and handling. Thus, the brassiere of the present invention can be used by and will be beneficial to those having post-surgery needs, arthritis, shingles, sleeping, walking, exercising, and comfort day and night.

BRIEF DESCRIPTION OF THE SEVERAL VIEWS OF THE DRAWING(S)

The foregoing and other features and advantages of the present invention will be more readily appreciated from the following detailed description when taken in conjunction with the accompanying drawings, wherein.

Figure 8:
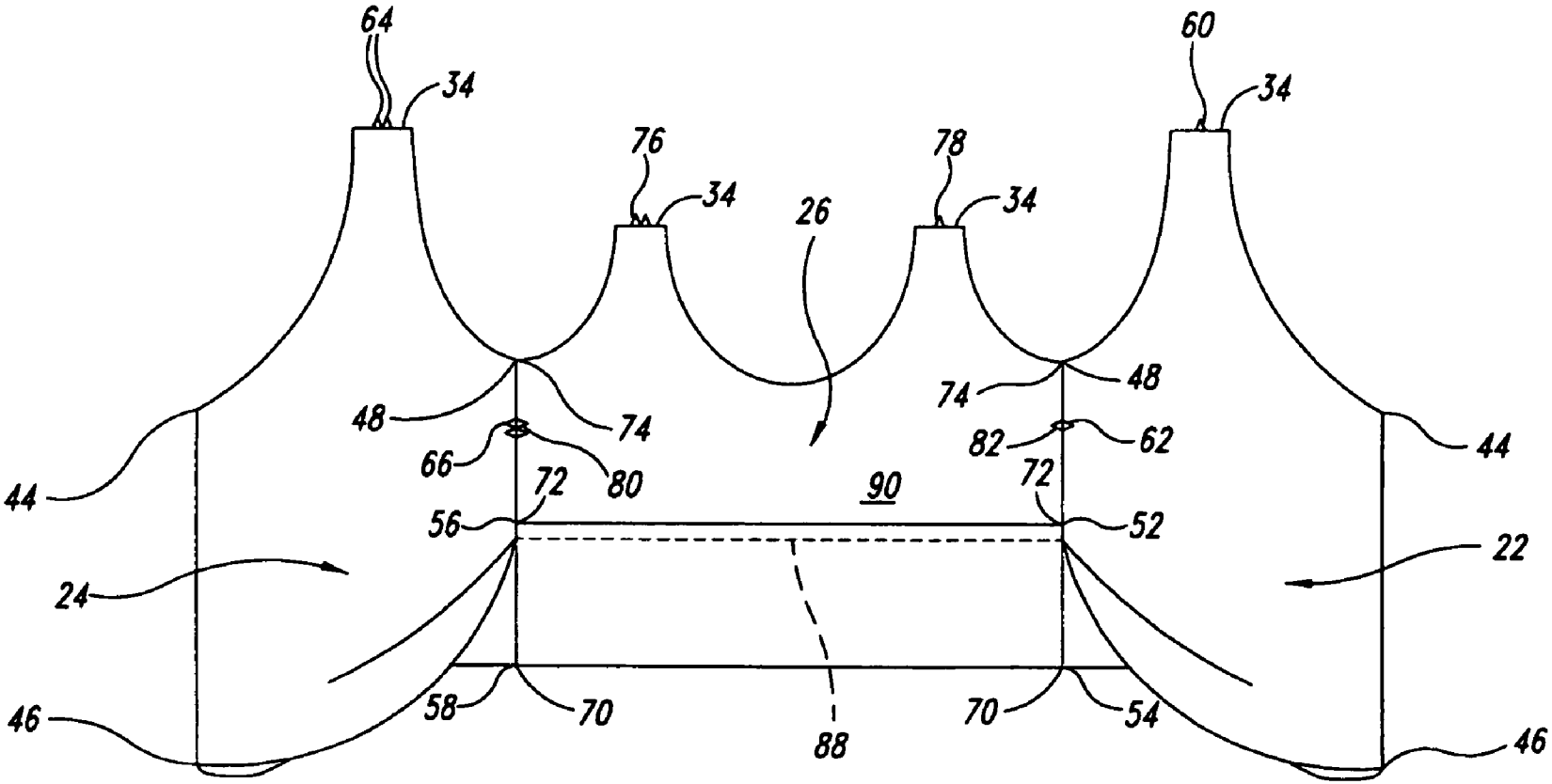
Figure 9:
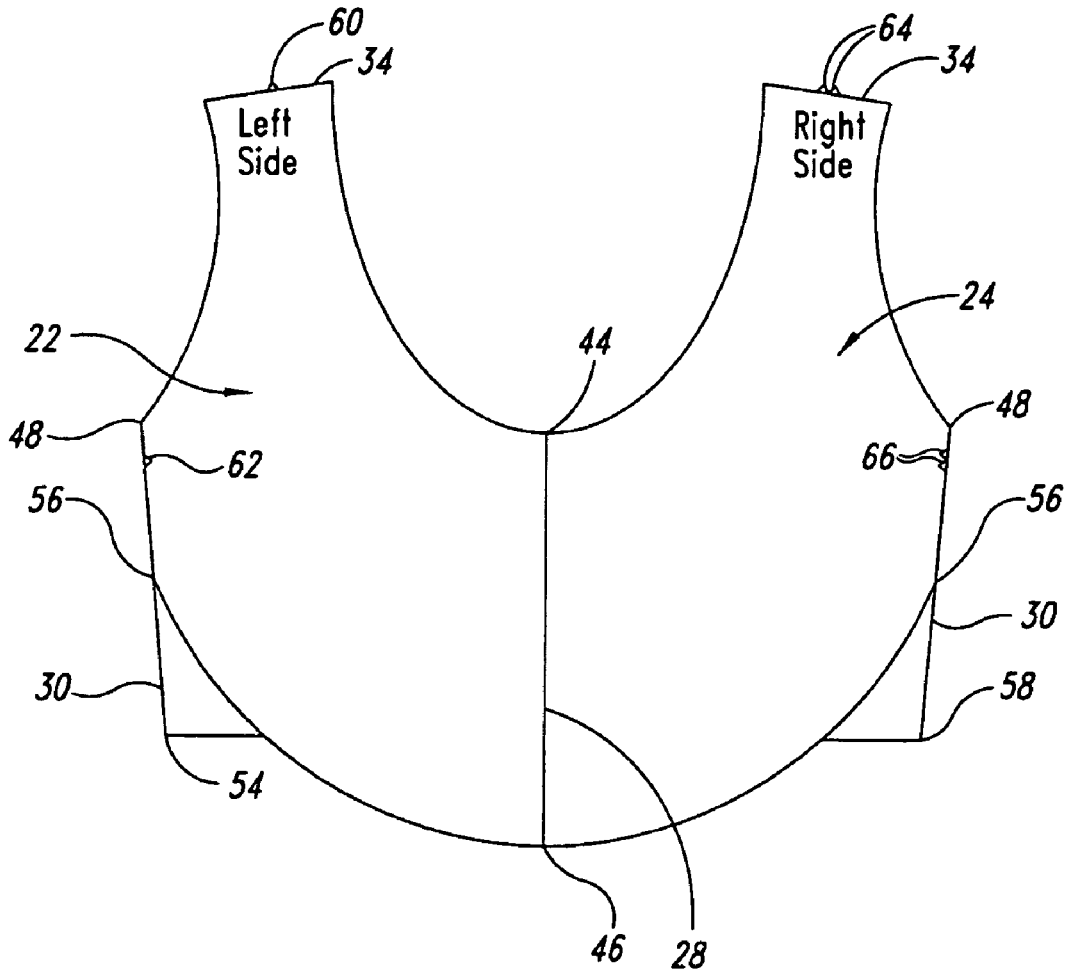
Figure 10:
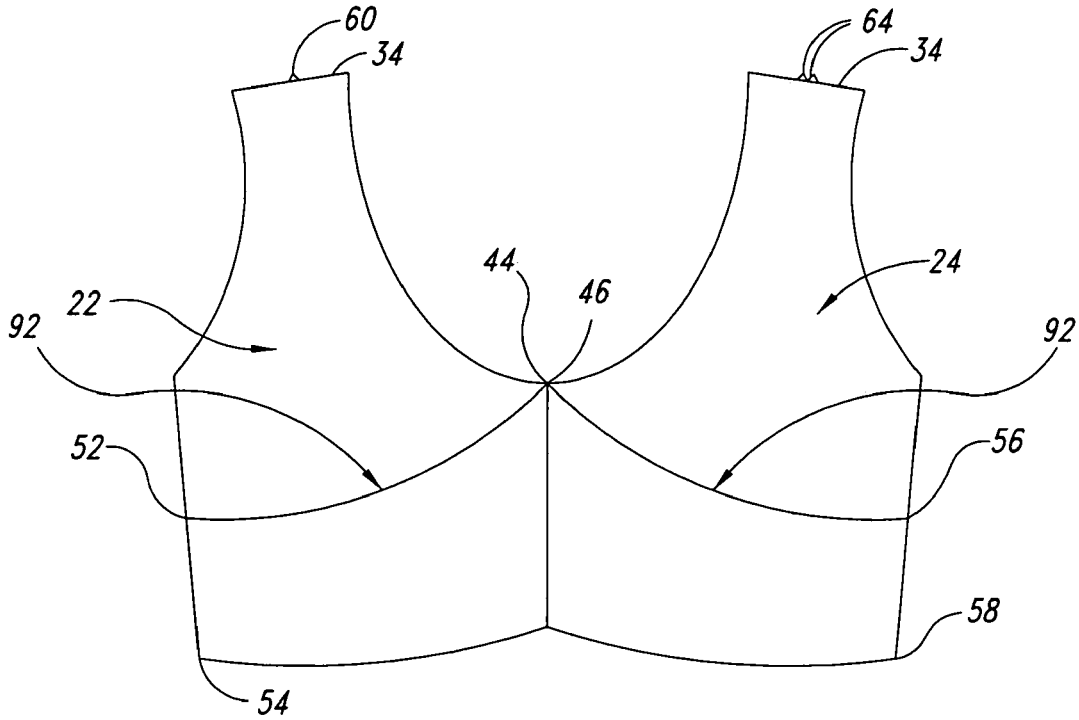
Figure 11:
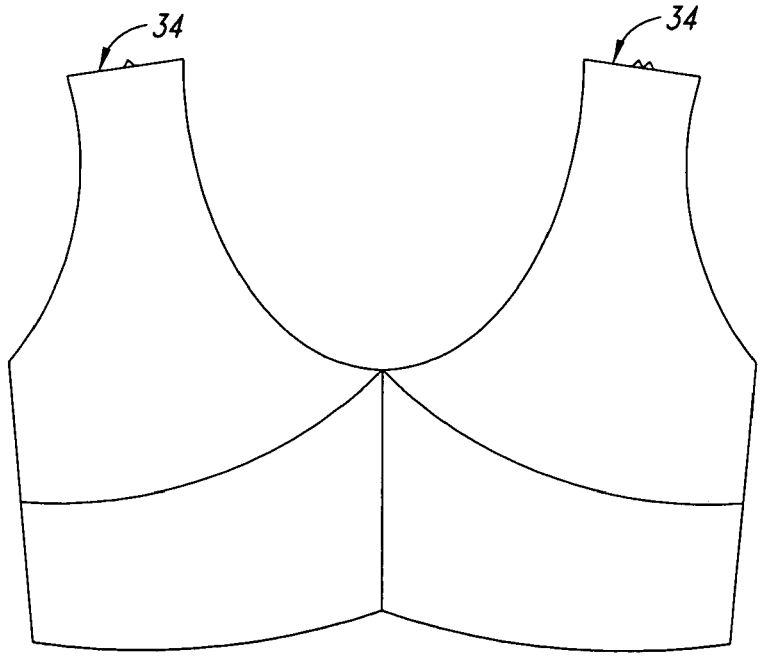
Figure 12:
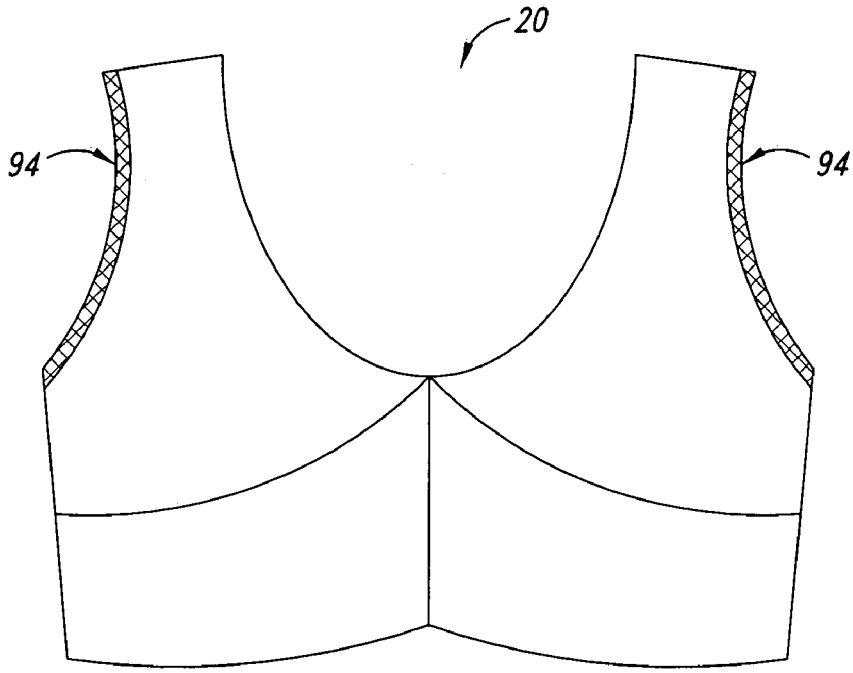
Figure 13:
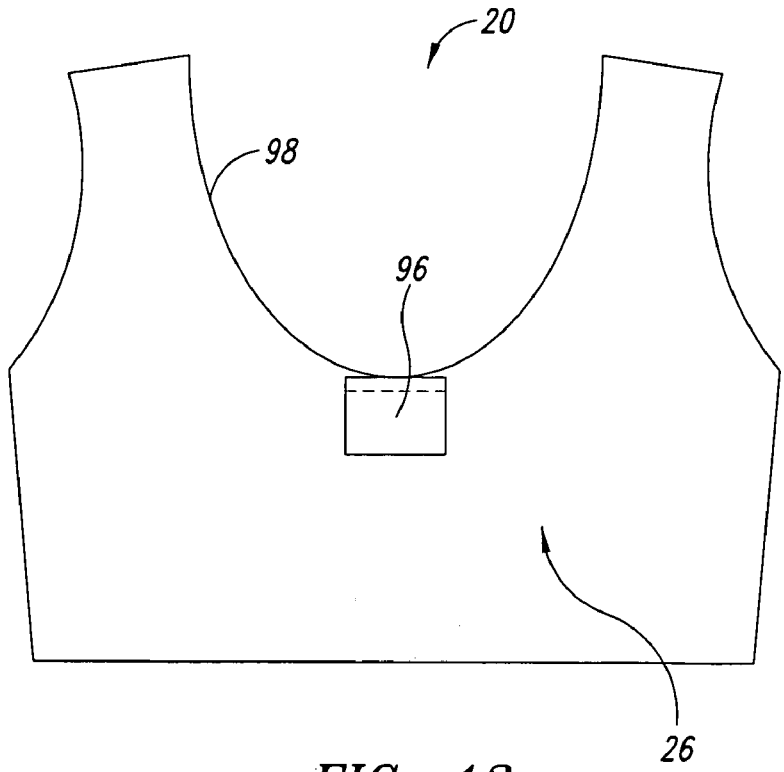
Figure 14:
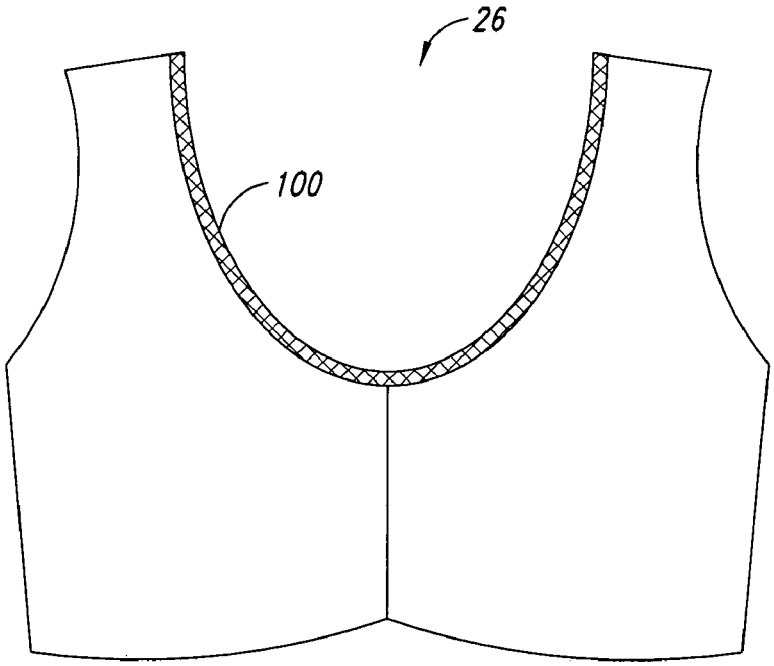
Figure 15:
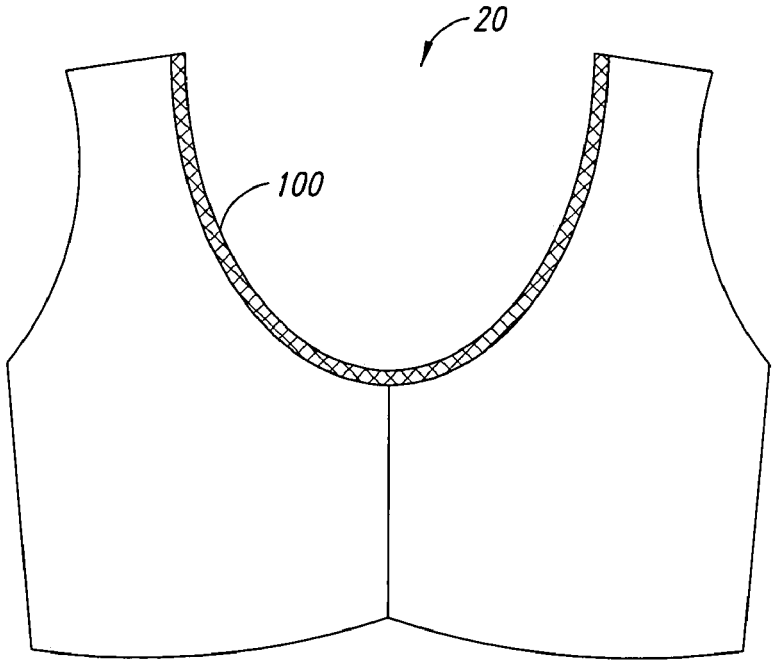
Figure 16:
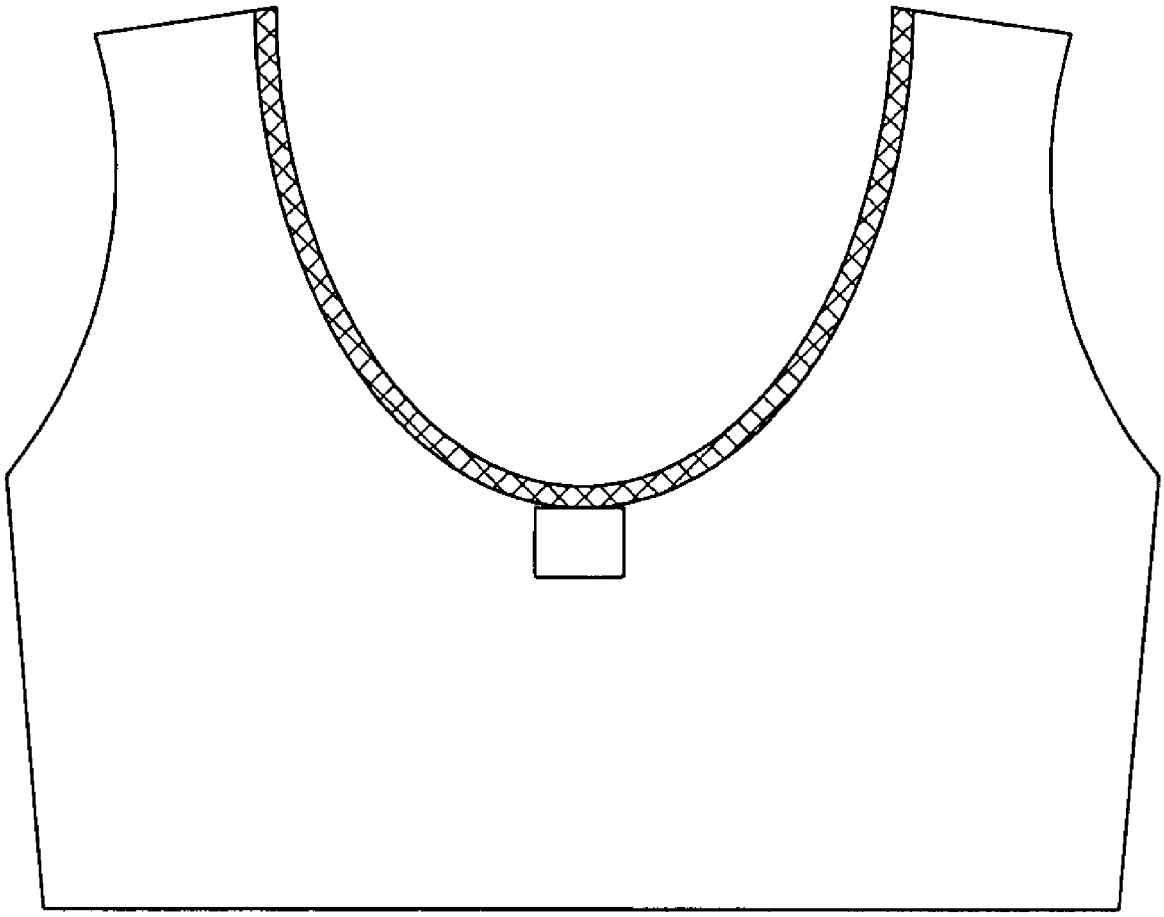

FIG. 8 wrong side up shows the back panel folded up and an unfinished edge stitched down in accordance with the present invention;

FIG. 9 wrong side up illustrates two front panels joined at a center front seam;

FIG. 10 wrong side up is a front view of the brassiere showing attachment of the front panels;

FIG. 11 wrong side up is a front view illustrating shoulder seams of the brassiere formed in accordance with the present invention;

FIG. 12 wrong side up is a front view illustrating the arm hole seams turned under in accordance with the present invention;

FIG. 13 is a right side up back view of the brassiere of the present invention illustrating an outside label applied thereto;

FIG. 14 is a right side up front view of the brassiere formed in accordance with the present invention showing trim attached thereto;

FIG. 15 is a right side up front view of the brassiere of FIG. 14 showing the finished stitching; and FIG. 16 is a right side up back view of the brassiere of FIG. 15 showing the finished stitching.

DETAILED DESCRIPTION OF THE INVENTION

Representative embodiments of the present invention will now be described in conjunction with FIGS. 1-16. It is to be understood that while the embodiments of the invention are described in conjunction with a post-surgical brassiere and a method for constructing a post-surgical brassiere, it is to be understood that the present invention has other applications as well, such as swimming suits and nursing brassieres.

Figure 1:
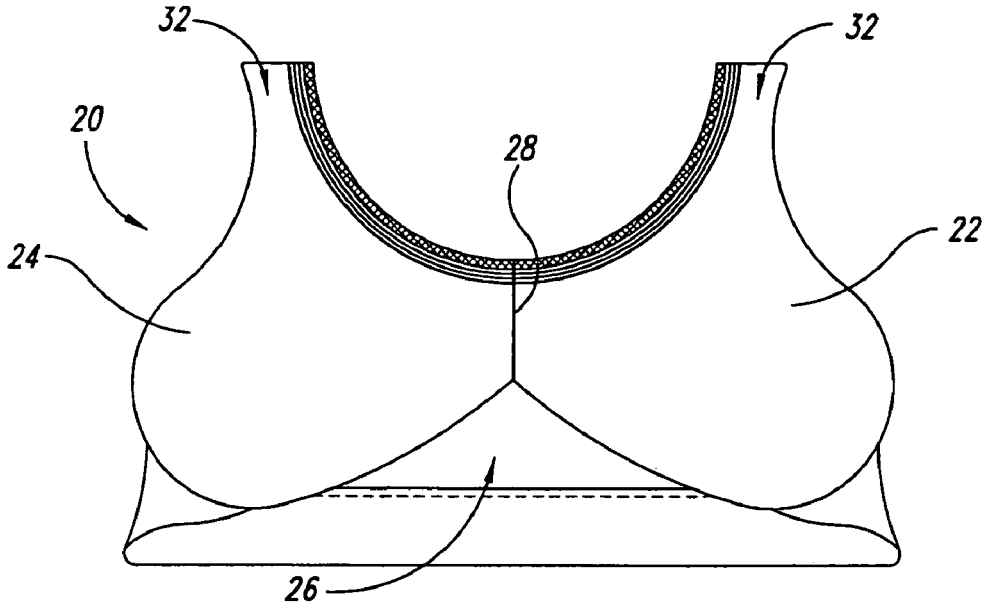
FIG. 1 is a front view of one embodiment of a brassiere formed in accordance with one embodiment of the present invention.
Figure 2:
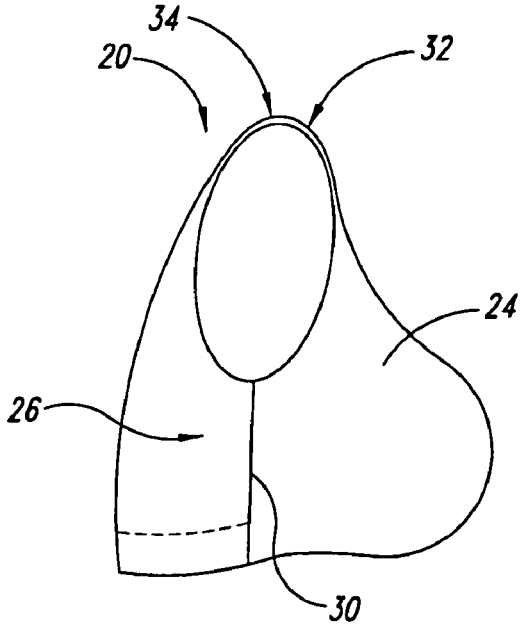
FIG. 2 is a side view of the brassiere of FIG. 1.

Referring initially to FIGS. 1 and 2, shown therein is a brassiere 20 formed in accordance with the present invention to include two front panels 22, 24 and a back panel 26. A center seam 28 connects the two front panels 22, 24 such that the two front panels 22, 24 form a hammock or cradle for breasts of the wearer as described in more detail below. Side seams 30 couple the front panels 22, 24 to the back panel 26, as shown in the right side view of FIG. 2. When so connected, shoulder areas 32 are formed, one shoulder area 32 is associated with each of the front panels 22, 24. As such, each shoulder area 32 is integrally formed with the front and rear panels 22, 24, and 26, respectively. Ideally, the shoulder areas 32 are sewn together at a top seam 34 in a preferred embodiment of the invention.

Figure 3:
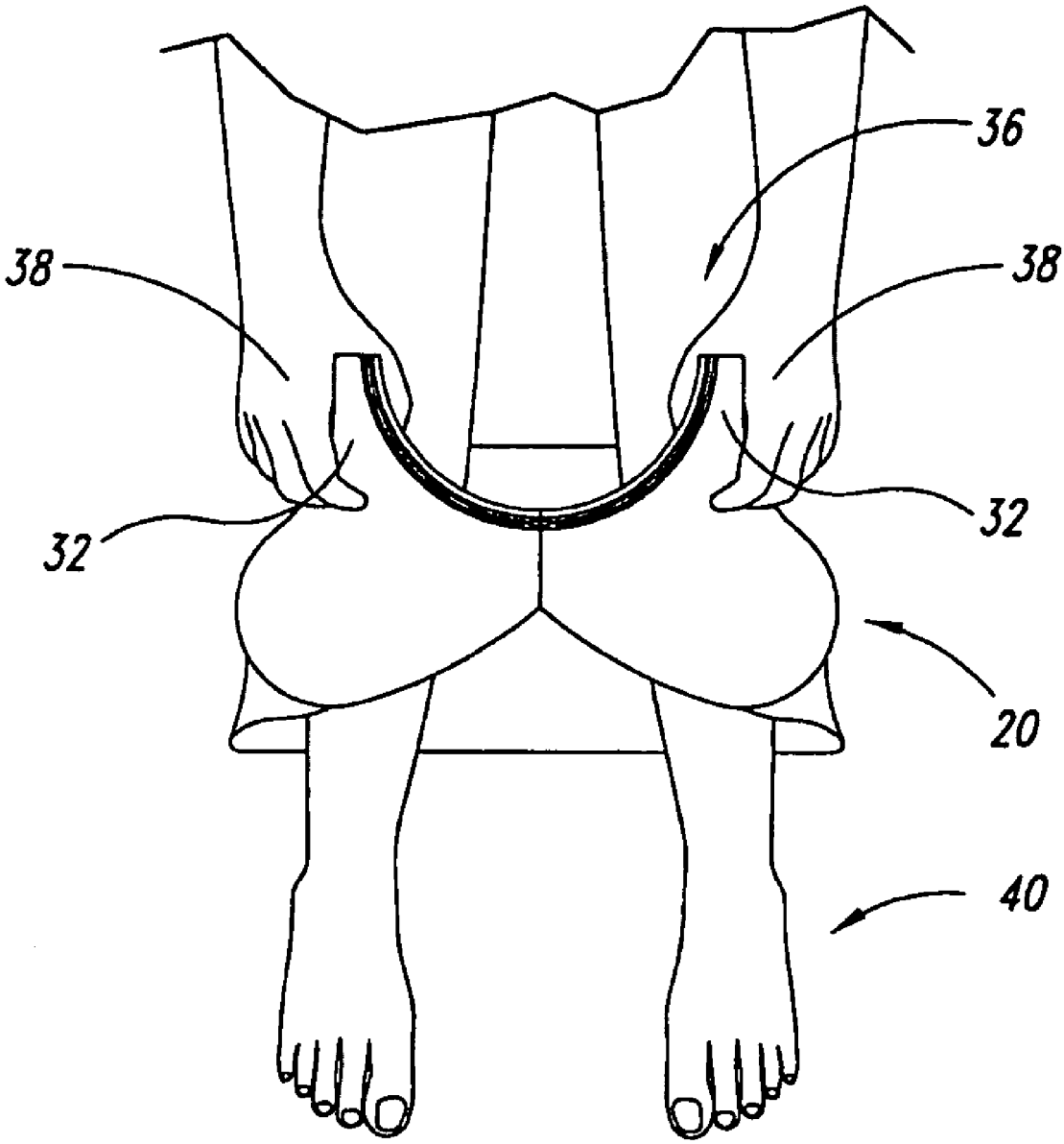
FIG. 3 is a front view illustrating stepping into the brassiere of FIG. 1.

FIG. 3 illustrates a user 36 grasping the shoulder areas 32 with her hands 38 and stepping into the brassiere 20 with her feet 40. Alternatively, the user 36 can pull the brassiere 20 over her head and onto her torso to be worn in a conventional manner.

Figures 4, 5:
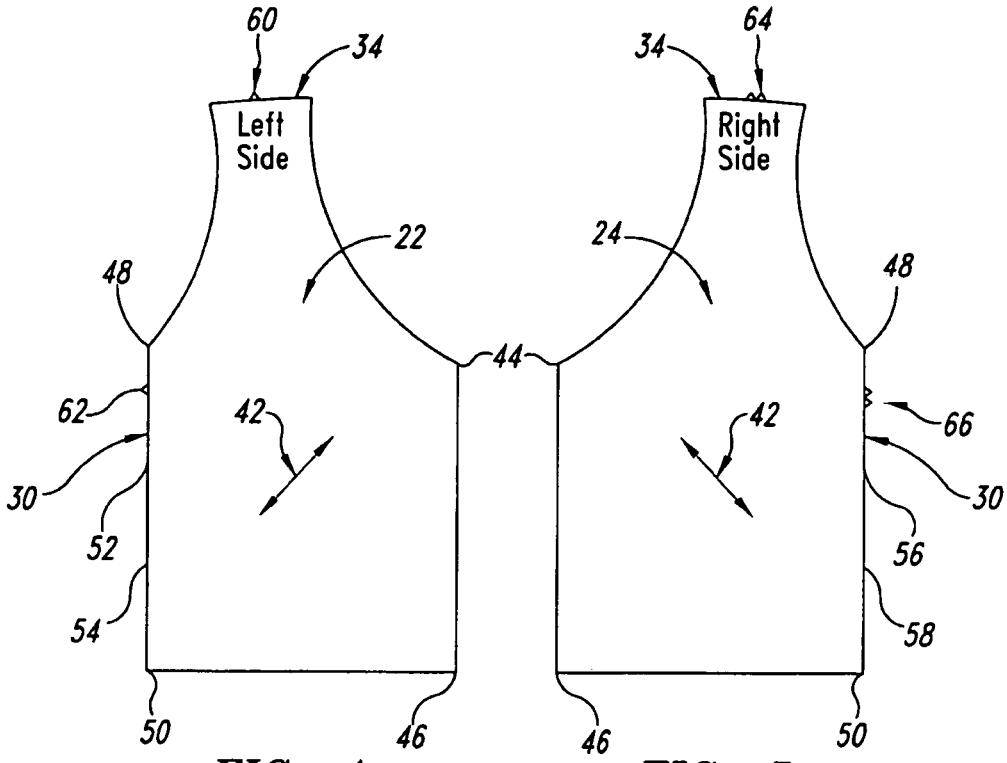
FIG. 4 is an illustration of a left front panel, wrong side up, of the brassiere of FIG. 1.
FIG. 5 is an illustration of a right front panel, wrong side up, of the brassiere of FIG. 1.

Referring next to FIG. 4 and FIG. 5, shown therein are the left front panel 22 and right front panel 24 turned wrong side up. Ideally, one-way stretch cotton interlock fabric is used to provide maximum comfort and fit. The left and right panels 22, 24 are cut on the bias grain of the fabric, with the grain lines oriented as shown by the arrows 42 in each figure. When the panels 22, 24 are thus cut, a top center seam point 44, bottom center seam point 46, top side seam point 48, and bottom side seam point 50 are thus formed. Attachment points 52, 54 on the left front panel 22 have respective attachment points 56, 58 on the right front panel 24, with one notch 60 at the top left shoulder seam 34 and one notch 62 at the side seam 30. On the right front panel 24, two notches 64 are provided at the top shoulder seam 34 and two notches 66 are provided the side seam 30.

Figure 6:
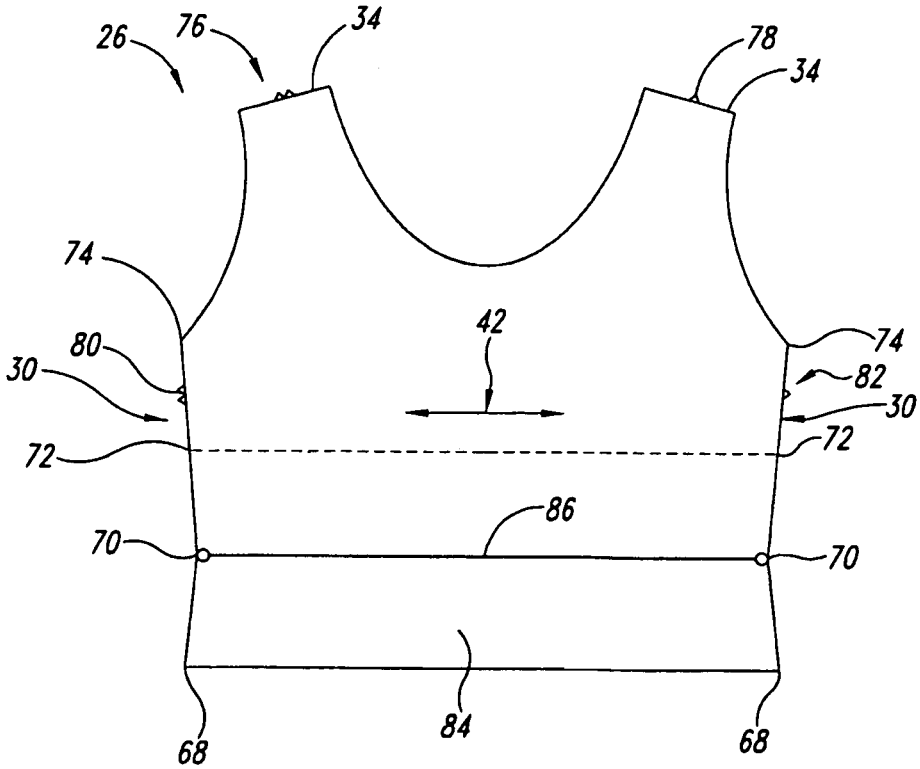
FIG. 6 is an illustration of a back panel, wrong side up, of the brassiere of FIG. 1.
Figure 7:
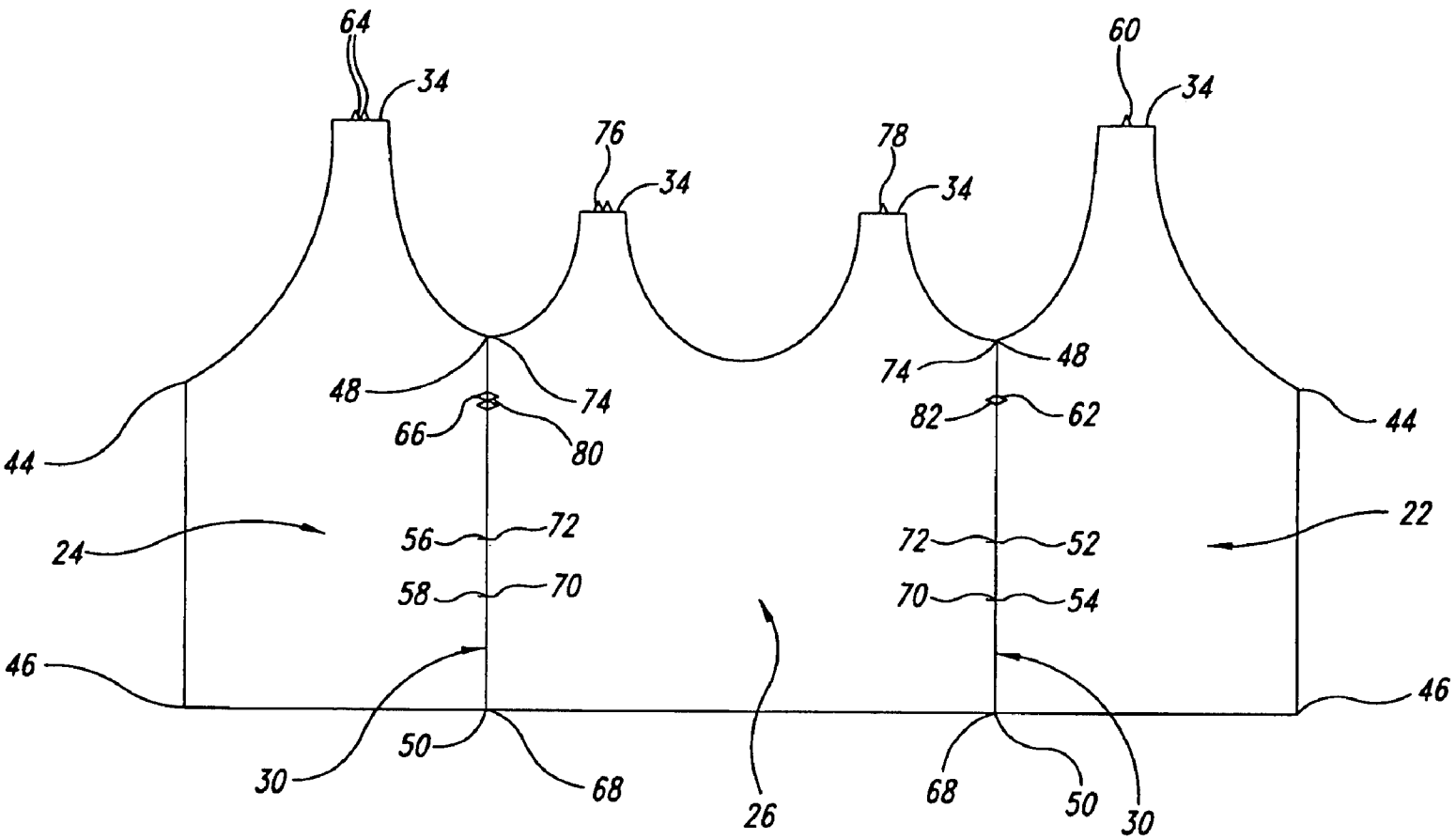
FIG. 7 illustrates two front panels wrong side up joining a back panel wrong side up at side seams in accordance with one embodiment of the invention.

Referring next to FIG. 6, shown therein is the back panel 26 wrong side up with the grain arrow 42 showing a transverse orientation. Thus, the back panel 26 is cut on the lengthwise grain of the fabric to form a bottom side seam point 68, a fold line point 70, a stitching line point 72, a top point 74, two notches 76 on the right three-inch top shoulder seam 34, one notch 78 on the left top shoulder seam 34, two notches 80 on the right side seam 30, and a single notch 82 on the left side seam, also referenced with reference numeral 30. FIG. 7 illustrates the two front panels 22, 24 wrong side up joining the back panel 26 of FIG. 6 wrong side up at the side seams 30 with serger stitches along the respective attachment points.

In FIG. 8, the back panel 26 wrong side up has a lower portion 84 turned up along a fold line 86 (shown in FIG. 6) defined by the fold points 70. An elastic stitch 88 is used to secure the lower portion 84 to the back panel 26 on an inside surface 90.

The front panels 22, 24 are joined at the center seam 28 with serger stitching. The left and right front panels 22, 24 are also attached to the back panel 26 along the side seams 30 formed between the attachment points 48 and 50 shown in FIG. 7, while the center seam 28 is formed between the attachment points 44 and 46. As shown in FIG. 9, the section bounded by the seam 30 shows the inside bottom of the front that is formed when the fold 84 shown in FIG. 8 is secure. Then, as shown in FIG. 10 wrong side up, the lower center point 46 is brought up to and attached to the upper center point 44 with small elastic stitches, forming a raw-edged open hammock 92 in each of the left and right front panels 22, 24 at attachment points 56 and 58.

Referring next to FIG. 11 wrong side up, the top shoulder seams 34 are joined together wrong side up with the respective top shoulder seams of the back panel using serger stitching. The single and double notches 60, 64 are matched up to ensure the garment is correctly sewn together.

In FIG. 12 wrong side up, armhole seams 94 are turned under wrong side up and stitched down with an elastic stitch. In FIG. 13, the back panel 26 right side up is shown having an outside label 96 attached thereto at a center point formed along the raw edge 98 with elastic stitching.

FIG. 14 right side up shows a neckline trim 100 sewn on the right side of the fabric's raw edge with an elastic stitch.

Finally, in FIG. 15 the finished front view is shown right side up with neckline trim 100 on the front side and FIG. 16 shows the neckline trim 100 and label 96 along the back panel 26 of the finished product with the right side out.

The manner of using the post-surgical comfort brassiere 20 of the present invention solves a long-felt, long-existing, and unsolved need. Post thoracic surgery patients and radiation therapy patients have treated skin that is tender or burnt. Any skin-to-skin contact is very painful and is prevented with the design of the present invention, which uses no wires, bands, or closures. The brassiere 20 can be put on over the head or stepped into without raising one arm or both arms, which is important after lymph-node or shoulder surgery. The bias cut fronts of the brassiere form an open bias hammock with a raw edge that eliminates a seam across the breast or chest area. The open bias hammock 92 allows each breast to find its own level comfortably, which is important because every breast has its own configuration and size, especially after surgery. The hammock 92 holds the breasts away from the chest wall and ribcage without a pressure-constricting underband. The back panel 26 is cut on the lengthwise grain of the fabric, resulting in the vertical stretch that enables the brassiere 20 to be pulled over the head easily or stepped into without raising an arm high, such as above waist level or above shoulder level. The lengthwise cut also results in a comfortable back support while eliminating a loosening horizontal stretch.

The three-inch wide shoulder is wide enough to keep from slipping down without pressuring, constricting, or causing friction on the shoulder area. Ideally, the shoulder can have a width in the range of one inch to three and one-half inches, but the preferred width is three inches.

Preferably, the fabric is a soft, one-way stretch, 100% cotton interlock that breathes. Many stretch garments use synthetic fabrics that cause allergic reactions in many women. Although the brassiere of the present invention relates to surgical needs, it can be used as a gentle support for the breasts during exercising, walking, and sleeping, when a comfortable, bandless, cupless, closureless bra is needed to mitigate skin-to-skin contact between the breast and the upper torso.

Thus, it will be appreciated that the brassiere of the present invention provides a soft, comfortable protecting garment that is highly useful and needed by women after breast, lung, heart, melanoma, and rotary cuff surgery, as well as shingles and bursitis. It is also needed by women in nursing homes, especially those in wheelchairs where brassieres with underbands cause perspiration and rashes that result from the friction and rubbing constriction of the band. The brassiere of the present invention is also valuable as a comfort bra for walking, exercising, and sleeping with gentle support day and night. Ideally, it is machine washable and dryable to provide a healthy, protective garment.

The process of manufacturing is facilitated by the simple design of only three panels and a label, as well as by the high quality of the 100% cotton interlock fabric. The trim gives the garment a feminine feel, which is important when going through painful times. The choice of stepping into it or putting it on over the head is important when one arm cannot be raised. The absence of the underband, cups, shoulder areas, and closures eliminates the pain and discomfort that these elements typically inflict in a post-surgical environment. As the fabric and design conform to women's bodies, it can be worn comfortably by women of any size or shape. The small size of the garment and light weight of the accompanying packaging is ideal for shipping and handling.

The open hammock design is valuable in letting each breast find its own level for comfort and to conform to its own shape and size. This is very important after breast surgery. The soft comfortable fabric soothes and mitigates pain while protecting tender tissues and medicated areas. With the elimination of the underband, the brassiere 20 is successful in eliminating skin-on-skin problems where it is extremely important in thoracic surgery and burn treatment.

While the above description contains many specificities, these should not be construed as limitations on the scope of the invention, but rather as an exemplification of one preferred embodiment thereof. Many variations are possible. For example, instead of consisting of 100% white cotton interlock, the fabric could be in different colors or styles, solid or designs. The neckline can be turned under and stitched down without trim. The front can be cut longer and have a double folded hammock. The front and back can all be cut on lengthwise or crosswise grain. The brassiere 20 can be made with a combination of cotton and synthetics, a different weave than interlock, a different weight of cotton, or an all-synthetic fabric either one-way stretch or two-way stretch. It can also be made for a swim top in solid or patterned fabrics, and it can have a secured pocked for a locker key.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A garment that prevents contact between the skin of a breast and the skin of a user's torso, comprising:

at least one front panel having an outer side and an inner side;

at least one back panel having left and right edges attached to corresponding edges of the at least one front panel;

at least one shoulder area formed with the at least one front panel and the at least one back panel; and at least one inner panel extending from the at least one front panel and attached to the inner side of the at least one front panel to form at least one hammock having a portion that is configured to be positioned between the skin of the breast and the skin of the user's torso.

2. The garment of claim 1, wherein the at least one front panel, the at least one back panel, and the at least one inner panel are attached to at least one side seam.

3. The garment of claim 1, wherein the inner panel is attached to the inner side of the at least one front panel at a first seam.

4. The garment of claim 3, wherein the at least one front panel comprises a first and a second panel joined together at a second seam.

5. The garment of claim 4, wherein the inner panel is configured to attach to the first and the second panel at the second seam to form two hammocks.

6. The garment of claim 2, wherein the inner panel is integrally formed with the front panel along a lower edge of the front panel.

7. The garment of claim 1, wherein the at least one shoulder area is integrally formed with the at least one front panel and the at least one back panel.

* * * * *